United States Patent [19]

Korte

[11] 4,386,706

[45] Jun. 7, 1983

[54] FOOD CONTAINER AND COVER THEREFOR

[75] Inventor: Ralph J. Korte, Darien, Ill.

[73] Assignee: Champion International Corporation, Stamford, Conn.

[21] Appl. No.: 309,020

[22] Filed: Oct. 6, 1981

[51] Int. Cl.[3] ..... B65D 5/74; B65D 47/04

[52] U.S. Cl. ..... 206/628; 206/612; 229/3.5 MF; 229/43

[58] Field of Search ..... 206/611, 612, 628, 633, 206/557; 229/43; 220/3.5 MF

[56] References Cited

U.S. PATENT DOCUMENTS

| | | | |
|---|---|---|---|
| 3,054,680 | 9/1962 | Mennen | 206/628 |
| 3,140,034 | 7/1964 | Wyman et al. | 229/3.5 |
| 3,410,697 | 11/1968 | Stephenson | 229/43 |
| 3,531,298 | 9/1970 | Donahue | 229/43 |
| 3,854,649 | 12/1974 | Wagner et al. | 229/43 |
| 4,211,360 | 7/1980 | Scott et al. | 229/43 |

*Primary Examiner*—William T. Dixson, Jr.
*Assistant Examiner*—Jimmy G. Foster
*Attorney, Agent, or Firm*—Evelyn M. Sommer

[57] ABSTRACT

A food container and a cover for the container, the cover being of the type which is secured to the container and is formed with rupturable cut score lines so that the cover can be neatly and easily torn off the container. The cover is formed with an interrupted perforated line adjacent to the rupturable cut score lines so that stresses produced at the periphery of the cover when the container is assembled are at least partially lowered to prevent the cut score lines from prematurely rupturing during assembly of the container. Containers of this type are typically used for packaging popcorn which is to be popped in the container.

5 Claims, 4 Drawing Figures

2
4
6
8
10
12
14
15
16
18
20
22
24
26
28
30
32
34
36

FOOD CONTAINER AND COVER THEREFOR

This invention relates to an improved cover for a food container, which cover can be easily and neatly torn off of the container by means of pre-cut score lines formed in the cover. More particularly, this invention relates to an improved container cover which will not prematurely rupture when the cover is secured to the container.

The packaging of foods in metal containers in which they must be heated preparatory to serving is a widespread practice. Among the foods thus packaged are raw corn kernels for making popcorn. The container includes a relatively heavy gauge aluminum foil pan and a relatively light gauge expansible aluminum foil cover sealed around its periphery to the pan. A protective paperboard cover overlays the expansible aluminum foil cover to protect the foil cover and to provide for graphics display on the top of the container. The paperboard cover can be removed from the container by means of cut score lines formed in the cover close to the periphery of the cover, and a tear tab formed in the cover. Removal is accomplished by lifting the tear tab and pulling upward whereby the central portion of the cover is peeled off of the container with rupture of the cover occurring along the cut score lines. The peripheral margin of the cover is left attached to the container. The container also includes a wire handle which has a first portion which is secured to the periphery of the container coextensive with the periphery of the cover, and which has a second portion extending outwardly of the container to provide means for manually grasping the handle. The heavy gauge aluminum foil pan and the light gauge aluminum foil cover are sealed to each other about their coextensive edges, with the sealed edges providing a crimping skirt which is folded over the margin of the light gauge aluminum foil cover to overlie the periphery of the paperboard cover and the first portion of the wire handle. The crimping skirt is then crimped down onto the margin of the light gauge aluminum foil cover to secure the paperboard cover and the wire handle to the container.

U.S. Pat. Nos. 4,194,680, issued Mar. 25, 1980 to Scott et al; 4,194,681, issued Mar. 25, 1980 to Scott et al; 4,211,360, issued July 8, 1980 to Scott et al; Des. No. 258,350, issued Feb. 24, 1981 to Scott et al; Des. 259,103, issued May 5, 1981 to Scott et al; and Des. 260,370, issued Aug. 25, 1981 to Peterson; and applications Ser. Nos. 941,951, filed Dec. 21, 1978 to Scott et al; and 971,955, filed Dec. 21, 1978 to Scott et al all disclose the general type of paperboard container cover described above.

A problem has arisen in connection with the assembly of this type of container where the paperboard cover is formed in accordance with the teachings of the prior art. When the handle and paperboard cover are secured to the container by the crimping of the compound foil skirt, the crimping forces utilized have been sufficient to produce a premature rupturing or delamination of the cut score lines formed in the paperboard cover to facilitate removal thereof from the container. This premature delamination, or partial delamination is naturally undesirable as it weakens the container structure and presents an unsightly appearance.

The improved paperboard cover and container of this invention permit assembly of the container with adequate crimping force without the cover delamination experienced with the prior art devices. The cover of this invention is formed with the cut score opening zone, as in the prior art, and is also formed with an interrupted perforate line disposed between the periphery of the cover and the cut score opening zone. The interrupted perforated line extends completely around the cover to surround the cut score opening zone outwardly of the latter. The interrupted perforated line disposed between the crimped area and the cut score opening zone serves to sufficiently locally increase the flexibility of the paperboard cover so that the stress forces imparted to the paperboard cover during the crimping operation are not fully transmitted to the cut score opening zone whereby the latter does not delaminate. Neither does the interrupted perforated line rupture during the crimping operation. Thus the paperboard cover is secured intact to the container without premature rupture occurring in the cover.

It is, therefore, an object of this invention to provide an improved food container and paperboard cover therefor of the type wherein the majority of the paperboard cover can be cleanly torn off of the container.

It is an additional object of this invention to provide a container and cover of the character described wherein the cover is attached to the container by a marginal crimping of the container material, and the cover is formed with an internal cut score zone which can be intentionally ruptured to remove the central portion of the cover from the container.

It is a further object of this invention to provide a container and cover of the character described wherein the cover is provided with stress relieving means which prevents premature rupture of the cut score zone when the margin of the container is crimped to secure the cover to the container.

These and other objects and advantages of the invention will become more readily apparent from the following detailed description of a preferred embodiment of the invention taken in conjunction with the accompanying drawings, in which.

Figures 1, 2, 3, 4:
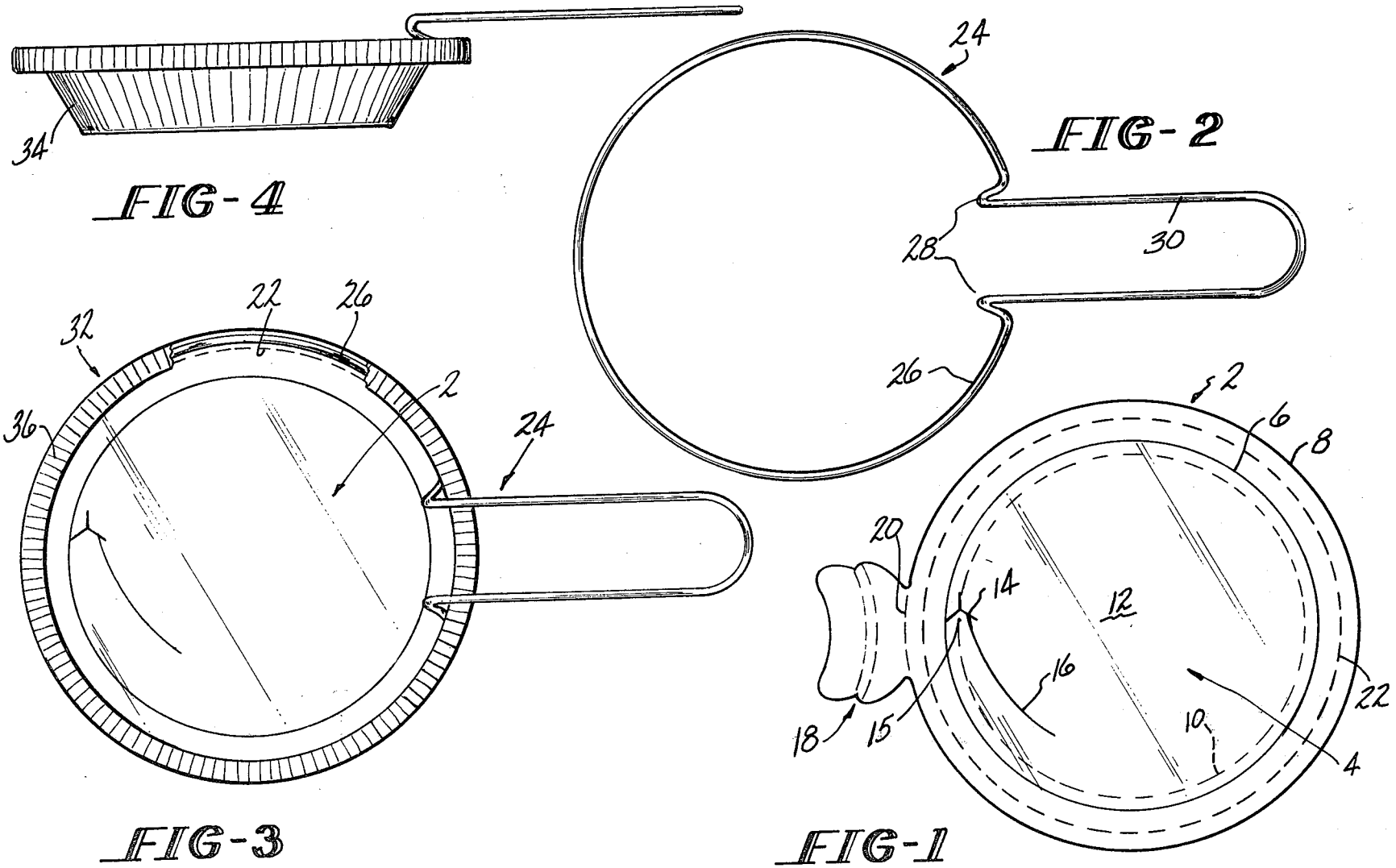
FIG. 1 is a top plan view of a preferred embodiment of an improved paperboard cover for a container formed in accordance with this invention.
FIG. 2 is a top plan view of a wire handle member adapted for use as a component part of the container of this invention.
FIG. 3 is a top plan view of a preferred embodiment of a container formed in accordance with this invention utilizing the cover shown in FIG. 1.
FIG. 4 is a side elevational view of the container of FIG. 3.

Referring now to the drawings, there is shown in FIG. 1 a preferred embodiment of a paperboard cover formed in accordance with this invention, the cover being referred to generally by the numeral 2. The cover 2, as depicted in FIG. 1 is shown with its outer surface 4, i.e., the surface upon which graphics and printing are disposed, facing the viewer. The cover shown is one which is adapted for use on a popcorn popping container, and is round in shape. A first circular cut score line 6 which extends through approximately half of the thickness of the cover 2 is formed in the outer surface thereof spaced inwardly from the outer edge 8 of the cover 2. A second circular cut score line 10 which extends through approximately half of the thickness of the cover 2 is formed in the inner surface thereof, the second cut score line 10 being spaced inwardly a short distance from the first cut score line 6. The two cut score lines 6 and 10 combine to define a circular central portion 12 of the cover 2 which can be torn or peeled away from the remainder of the cover 2 to expose the underlying thin gauge foil cover on the popcorn container prior to popping the corn contained therein. A V-shaped through cut line 14 is disposed on the cover 2 to define a manually graspable tear tab 15 which is pulled away from the outer surface 4 of the cover 2 to remove the central portion 12 from the remainder of the cover 2. An arcuate partial cut line 16 is formed in the cover 2 to facilitate such removal. A tuck tab 18 is connected to the outer edge 8 of the cover 2 and is folded about a fold line 20 against the inner surface of the cover 2 to underlie the tear tab 15 to ensure that the thin gauge foil cover of the container is not accidentally punctured when the tear tab 15 is grasped. An interrupted perforated line 22 is formed in the cover 2 between the outer edge 8 and the first cut score line 6. The interrupted perforated line 22 is preferably perforated from the inner surface of the cover 2 in the particular cover shown herein.

The handle member 24 is shown in FIG. 2, the handle 24 including a circular loop portion 26, a pair of upwardly extending bridge portions 28, and an elongated grasping portion 30 which is adapted to be manually gripped during popping of the popcorn in the container.

Referring now to FIGS. 3 and 4, the assembled container, denoted generally by the numeral 32, as shown. The container 32, as previously noted, includes a pan portion 34 formed from relatively heavy gauge aluminum foil, and a top expansible cover (not shown) formed from pleated relatively light gauge aluminum foil. The paperboard cover 2 overlies the top expansible cover in the assembled container. The outer margin of the pan 34 and the outer margin of the top expansible cover are bonded together and are folded over and crimped, as at 36, down over the loop portion 26 of the handle 24 after the loop portion 26 has been positioned over the marginal portion of the paperboard cover 2. It will be noted from the cut away portion of FIG. 3 that the interrupted perforated line 22 on the paperboard cover 2 is disposed slightly inwardly of the loop portion 26 of the handle 24, and underlies the crimped margin 36 of the foil laminate. Thus the crimped margin 36 of the foil laminate serves to hold the handle 24 and the paperboard cover 2 in place on the container 32. In order to insure that the handle 24 and paperboard cover are held securely in place, rather considerable crimping force is applied to the margin 36 when the latter is formed. The positioning of the interrupted perforated line 22 between the crimped margin 36 and the first cut score line 6 ensures that the first cut score line 6 will not delaminate or tear during the crimping operation. The interrupted perforated line 22 provides increased flexibility to the paperboard cover 2 between the area thereof to which the crimping force is applied and the first cut score line 6. This increased flexibility lessens the stresses transmitted to the first cut score line 6 from the crimping area thereby preventing delamination at the first cut score line 6. At the same time, this increased flexibility prevents the interrupted perforated line 22 from itself rupturing. The perforations are preferably formed on the inner surface so that they can open without tearing when the crimping force is applied to the outer surface of the cover 2. For other applications, the perforations could be formed on the outer surface, if appropriate.

It will be readily appreciated that the paperboard cover and the container of this invention will provide an attractive assembly which is devoid of delamination problems with minimal corrective alterations.

Since many changes and variations of the disclosed embodiment of the invention may be made without departing from the inventive concept, it is not intended to limit the invention except as required by the appended claims.

What is claimed is:

1. A paperboard cover for a container, said cover having an outer surface, an inner surface, and a marginal outer edge; a first cut score rupturable line formed in said outer surface and having a depth which is approximately one half the thickness of said cover, said first cut score line being inwardly offset from said marginal outer edge of said cover and defining the outer surface of a removable central portion of said cover; a second cut score rupturable line formed in said inner surface and having a depth which is approximately one half of the thickness of said cover, said second cut score line being inwardly offset from said first cut score line and defining the inner surface of said removable central portion of said cover; a pull tab connecting said first and second cut score lines to facilitate manual removal of said central portion of said cover; and a stress relieving interrupted non-rupturable perforated line formed in said cover between said first cut score line and said marginal outer edge of said cover, said interrupted non-rupturable perforated line surrounding said first cut score line, providing for flexibility of the cover between said non-rupturable perforated line and said rupturable lines.

2. The paperboard cover of claim 1, wherein said interrupted non-rupturable perforated line is formed in said inner surface of said cover.

3. A paperboard cover for a container, said cover having an outer surface, an inner surface, and a marginal outer edge; rupturable means in said cover defining a central removable portion of said cover; and a stress relieving non-rupturable interrupted perforated line on said cover interposed between said rupturable means and said outer marginal edge and completely surrounding said rupturable means providing for flexibility of the cover between said non-rupturable perforated line and said rupturable means to prevent premature rupture of said rupturable means.

4. A food container comprising:

(a) a relatively heavy gauge metallic foil pan;

(b) a relatively light gauge metallic foil cover;

(c) a crimping skirt defined by marginal portions of said foil pan and foil cover which are bonded together to seal the interior of said container and to form said crimping skirt;

(d) a paperboard cover overlying said light gauge metallic foil cover, said paperboard cover having a marginal outer edge, and rupturable means defining a central removable portion on said cover, said rupturable means being inwardly spaced from said marginal outer edge on said paperboard cover, and an interrupted non-rupturable perforated line in said paperboard cover interposed between said rupturable means and said marginal outer edge of said paperboard cover, said interrupted non-rupturable perforated line surrounding said rupturable means to provide for flexibility of the cover between said non-rupturable perforated line and said rupturable means; and (e) said crimping skirt being folded down over and crimped onto a marginal portion of said paperboard cover so as to overlie said marginal outer edge of said paperboard cover to secure said paperboard cover to said container, said interrupted perforated line being operable to provide relief of stress forces imparted to said paperboard cover by said crimped crimping skirt to prevent premature rupture of said rupturable means.

5. The food container of claim 4, further comprising a wire handle having a loop portion disposed beneath said crimping skirt, said wire handle being secured to said container by the crimping force of said crimping skirt.

* * * * *